US011160342B2

(12) United States Patent
Kikuta

(10) Patent No.: US 11,160,342 B2
(45) Date of Patent: Nov. 2, 2021

(54) FOLDABLE BAG

(71) Applicant: Marna Inc., Tokyo (JP)

(72) Inventor: Minami Kikuta, Tokyo (JP)

(73) Assignee: MARNA INC., Tokyo (JP)

( * ) Notice: Subject to any disclaimer, the term of this patent is extended or adjusted under 35 U.S.C. 154(b) by 0 days.

(21) Appl. No.: 16/763,276

(22) PCT Filed: Nov. 28, 2018

(86) PCT No.: PCT/JP2018/043766
§ 371 (c)(1),
(2) Date: May 12, 2020

(87) PCT Pub. No.: WO2019/107406
PCT Pub. Date: Jun. 6, 2019

(65) Prior Publication Data

US 2021/0169189 A1 Jun. 10, 2021

(30) Foreign Application Priority Data

Nov. 30, 2017 (JP) ..... JP2017-229848

(51) Int. Cl.
*A45C 7/00* (2006.01)
*A45C 13/10* (2006.01)
*A45C 3/00* (2006.01)

(52) U.S. Cl.
CPC ..... *A45C 7/0077* (2013.01); *A45C 13/103* (2013.01); *A45C 2003/008* (2013.01)

(58) Field of Classification Search
CPC ..... A45C 7/0077; A45C 13/103; A45C 2003/008
(Continued)

(56) References Cited

U.S. PATENT DOCUMENTS 15,891 A * 10/1856 Mason ..... A45C 1/02 150/112
364,529 A * 6/1887 Lieker ..... A45C 3/06 150/112
(Continued)

FOREIGN PATENT DOCUMENTS

JP S58-173319 U 11/1983
JP 2005-343534 A 12/2005
(Continued)

OTHER PUBLICATIONS

Translation of International Search Report dated Jan. 15, 2019, issued in counterpart application No. PCT/JP2018/043766. (2 pages).
(Continued)

*Primary Examiner* — Peter N Helvey
(74) *Attorney, Agent, or Firm* — Westerman, Hattori, Daniels & Adrian, LLP

(57) ABSTRACT

This foldable bag (A) includes a container main body (B) having: a set of foldable surfaces (5) positioned on a front surface and a rear surface when the foldable bag is in a folded state; inner bottom pleats (6) formed from one longitudinal end side (M1) of each of the foldable surfaces toward an inner other end side, and having a width corresponding to a bottom gusset (20); a plurality of sets of top inner pleats (7,8) formed from the other longitudinal end side (M2) of each of the foldable surfaces toward an inner one end side, and having pleat widths that become gradually narrower toward the inner-facing side. After use, the container main body can be flipped over and folded into a flat rectangular shape by tensioning bundling end parts (C), at which side end parts (4) are sealed, in a direction pulling the bundling end pails apart.

3 Claims, 6 Drawing Sheets

(58) Field of Classification Search
USPC ..... 383/34.1
See application file for complete search history.

(56) References Cited

U.S. PATENT DOCUMENTS 449,791 A * 4/1891 Andrews ..... A45C 3/06 150/112
1,553,697 A 9/1925 Lederer
2,009,077 A * 7/1935 Walitzky ..... A45C 3/06 150/112
2,737,221 A * 3/1956 Knox ..... A45C 13/10 150/118
4,078,595 A * 3/1978 Mittelmann ..... A45C 3/06 150/112
4,153,146 A * 5/1979 Patton ..... A45C 7/0068 190/103
7,073,548 B1 * 7/2006 Berse-Hurley ..... A45C 7/0077 150/119
7,232,018 B1 * 6/2007 Salander ..... A45C 5/14 190/103
8,016,090 B2 * 9/2011 McCoy ..... A45C 7/0077 190/107
8,132,601 B2 * 3/2012 Wang ..... B65D 31/12 150/113
10,806,225 B2 * 10/2020 Sitnikova ..... A45C 13/26
2006/0177161 A1 * 8/2006 Turvey ..... B65D 33/2591 383/120
2006/0262996 A1 * 11/2006 Vazquez ..... A45C 7/0063 383/2

FOREIGN PATENT DOCUMENTS

JP 2010-517724 A 5/2010
WO 2008/101009 A1 8/2008
WO 2017/033902 A1 3/2017

OTHER PUBLICATIONS

Decision to Grant Patent dated Dec. 21, 2018, issued in counterpart JP Application No. 2017-229848, with English Translation. (5 pages).

* cited by examiner

FOLDABLE BAG

TECHNICAL FIELD

The present invention relates to bags, and particularly to a foldable bag that is convenient for carrying when not in use.

BACKGROUND ART

Conventionally, various bags that are formed of sheet materials and that can be folded into a compact form for carrying when not in use have been proposed.

As an example of such a foldable bag, there is a conventionally known bag that includes a storage body 1 formed of a nylon sheet, having an elongated entrance 6, and sealed at both ends with seams 3; a zipper 6A for opening and closing the entrance 6; and bellows portions 5 disposed on both sides of the zipper 6A in the longitudinal direction so that the extent of the planar area can be reduced when the storage body 1 is folded (see, for example, PTL 1).

In addition, as a foldable bag that is formed of a sheet material and that can be folded into a predetermined rectangular flat band form closed at both ends in the longitudinal direction after use simply by pulling both end portions in directions away from each other, there is a conventionally known handbag having an opening 100a for insertion and removal of an article, the opening 100a extending linearly from one end portion to the other end portion in the center or along one side edge in the width direction when the bag is in the band form; a bag main body which has a bellows structure composed of a plurality of pleats 12 located in one half 10a and the other half 10b on both sides of the opening 100a and formed by repeatedly making mountain and valley folds at a predetermined width and in which the end portions of the plurality of pleats 12 are closed in a stacked state; first and second tunnel portions 18a and 18b formed in the one half 10a and the other half 10b and extending along the opening 100a; a first flat strap ST1 inserted into the first tunnel portion 18a and having a width; and a second flat strap ST2 inserted into the second tunnel portion 18b and having a width. The size of the opening 100a can be reduced by pulling portions of the first and second straps ST1 and ST2 out of both ends of the first and second tunnel portions, and the handbag can be carried using the first and second straps ST1 and ST2 (see, for example, PTL 2).

CITATION LIST

Patent Literature

PTL 1: Japanese Unexamined Patent Application Publication No. 7-308215

PTL 2: International Publication No. 2017/033902

SUMMARY OF INVENTION

Technical Problem

For the bag described in PTL 1 above, as shown in FIGS. 4 and 5, when the storage body 1 is packed with an article 11, the bellows portions 5 are extended, and the storage body 1 is expanded into a shape conforming to the shape of the article 11; therefore, this bag has a problem in that its appearance in use is poor as a bag.

The foldable bag described in PTL 2 above can be folded into a predetermined rectangular flat band form closed at both ends in the longitudinal direction simply by pulling both end portions in directions away from each other; however, as with the bag described in PTL 1 above, this bag has a problem in that its appearance in use cannot be shaped such that, like normal bags, the bottom surface is flat, the front and rear body portions stand upright, and the top surface is round.

An object of the present invention is to solve the foregoing problem and provide a foldable bag that can be shaped as its appearance in use such that the bottom surface is flat, the front and rear body portions stand upright, and the top surface is round, and that is easily foldable after use by turning the foldable bag inside out and tensioning both ends in the longitudinal direction in directions away from each other.

Solution to Problem

To solve the foregoing problem, the present invention provides a foldable bag that is foldable into a rectangular flat shape. The foldable bag employs a configuration including a storage main body having a set of folding surfaces located on front and rear sides when the foldable bag is folded into the rectangular flat shape, an inner bottom pleat formed from one end side inwardly toward another end side of both front and rear folding surfaces in a longitudinal direction and having a width corresponding to a bottom gusset, and a plurality of sets of inner top pleats formed from the other end side inwardly toward the one end side of the front and rear folding surfaces in the longitudinal direction and having a width that becomes gradually narrower inwardly toward an opposing side; a storage entrance part for insertion and removal of an article to be stored, the storage entrance part being formed on an innermost side of the plurality of sets of inner top pleats of the folded storage main body; a set of bundle end parts sewn to folded side end portions of the storage main body to seal side ends of the inner bottom pleat and the plurality of sets of inner top pleats formed in the folded storage main body in a stacked state; and a handle attached outside the storage entrance part of the folded storage main body. The storage main body is foldable by turning the foldable bag in a usable state inside out and tensioning the set of bundle end parts in directions away from each other.

As a specific embodiment of the storage main body forming the foldable bag, the foldable bag employs a configuration in which the storage main body is formed of a rectangular sheet material defined by long sides and short sides and in which the sheet material is foldable along a first valley fold line formed on a perpendicular bisector of the long sides; a set of first mountain fold lines formed at a spacing S1 that is half a width of the bottom gusset from the first valley fold line toward the short sides and corresponding to the one end side of the front and rear folding surfaces in the longitudinal direction; a set of second mountain fold lines formed at a spacing S2 that is twice or more the spacing S1 from the first mountain fold lines toward the short sides and corresponding to the other end side of the front and rear folding surfaces in the longitudinal direction; a set of second valley fold lines formed at a spacing S3 narrower than the spacing S1 from the second mountain fold lines toward the short sides and corresponding to first inner top pleats; a set of third mountain fold lines formed at the spacing S3 from the second valley fold lines toward the short sides and corresponding to second inner top pleats; and a plurality of sets of valley fold lines and mountain fold lines formed at a spacing that becomes gradually narrower than the spacing S3 from the third mountain fold lines toward the short sides.

In addition, as a specific embodiment of the storage entrance part, the foldable bag employs a configuration in which the storage main body includes a zipper for opening and closing the storage entrance part along the storage entrance part.

Advantageous Effects of Invention

By employing the foregoing configurations, the foldable bag of the present invention can be shaped as its appearance in use such that the bottom surface is flat, the front and rear body portions stand upright, and the top surface is round, and the storage main body can be easily folded into a rectangular flat shape after use simply by turning the foldable bag inside out and tensioning the bundle end parts in directions away from each other.

In addition, because the storage main body of the foldable bag of the present invention is fabricated by folding a single rectangular sheet material defined by long side and short sides along valley fold lines and mountain fold lines parallel to the short sides, the fabrication process can be simplified.

DESCRIPTION OF EMBODIMENTS

Next, a foldable bag according to an embodiment of the present invention will be described with reference to the drawings shown in the Example.

In the following description, as viewed in the front view of FIG. 1(*a*), the vertical direction is referred to as "top/bottom", the horizontal direction is referred to as "left/right", and the direction from the viewer into the page is referred to as "front/rear".

Example

Figure 1:
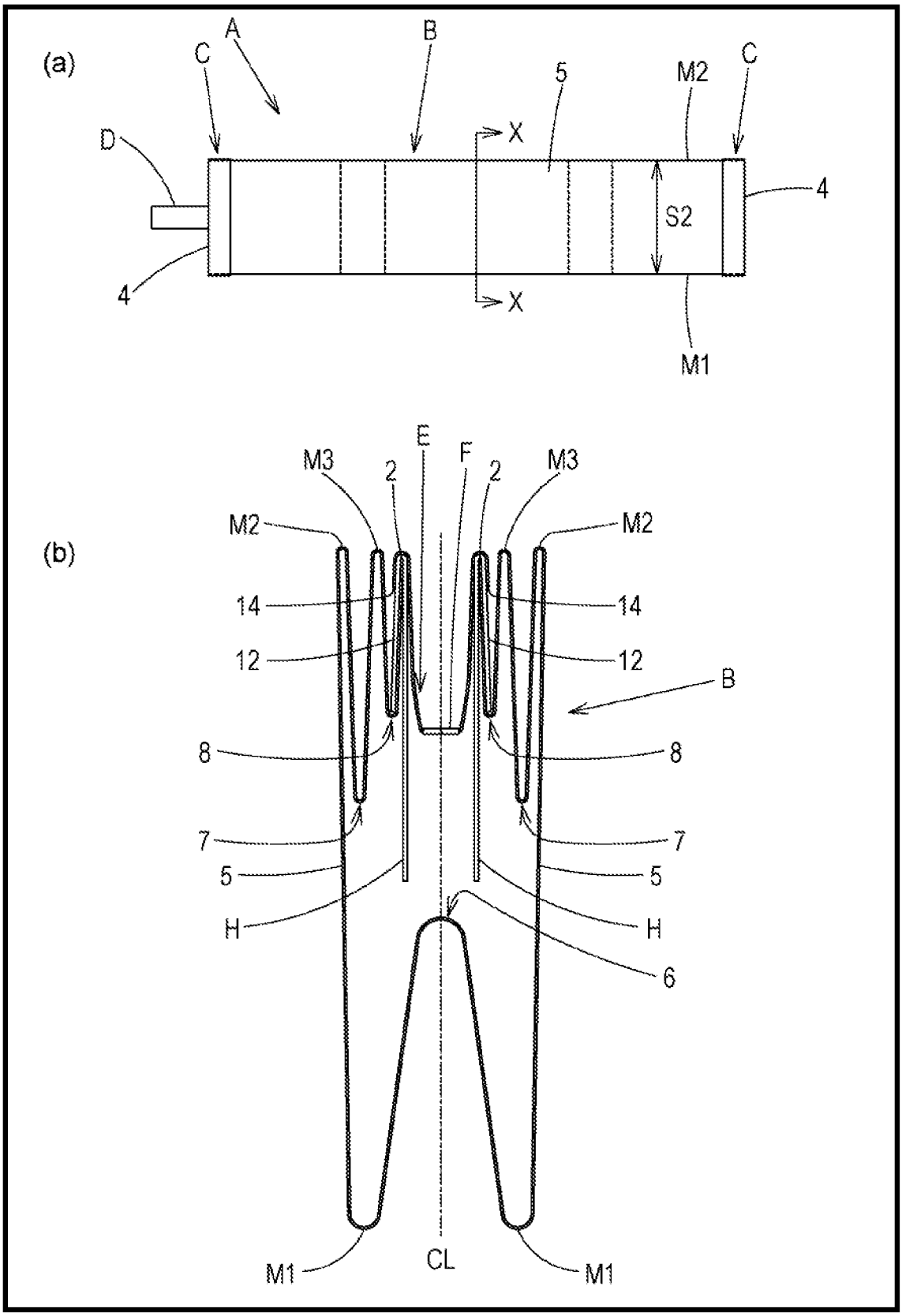
FIG. 1 shows a bag that is an example of the present invention in a folded state, where (a) is a front view, and (b) is a sectional view as viewed along arrows X-X.
Figure 2:
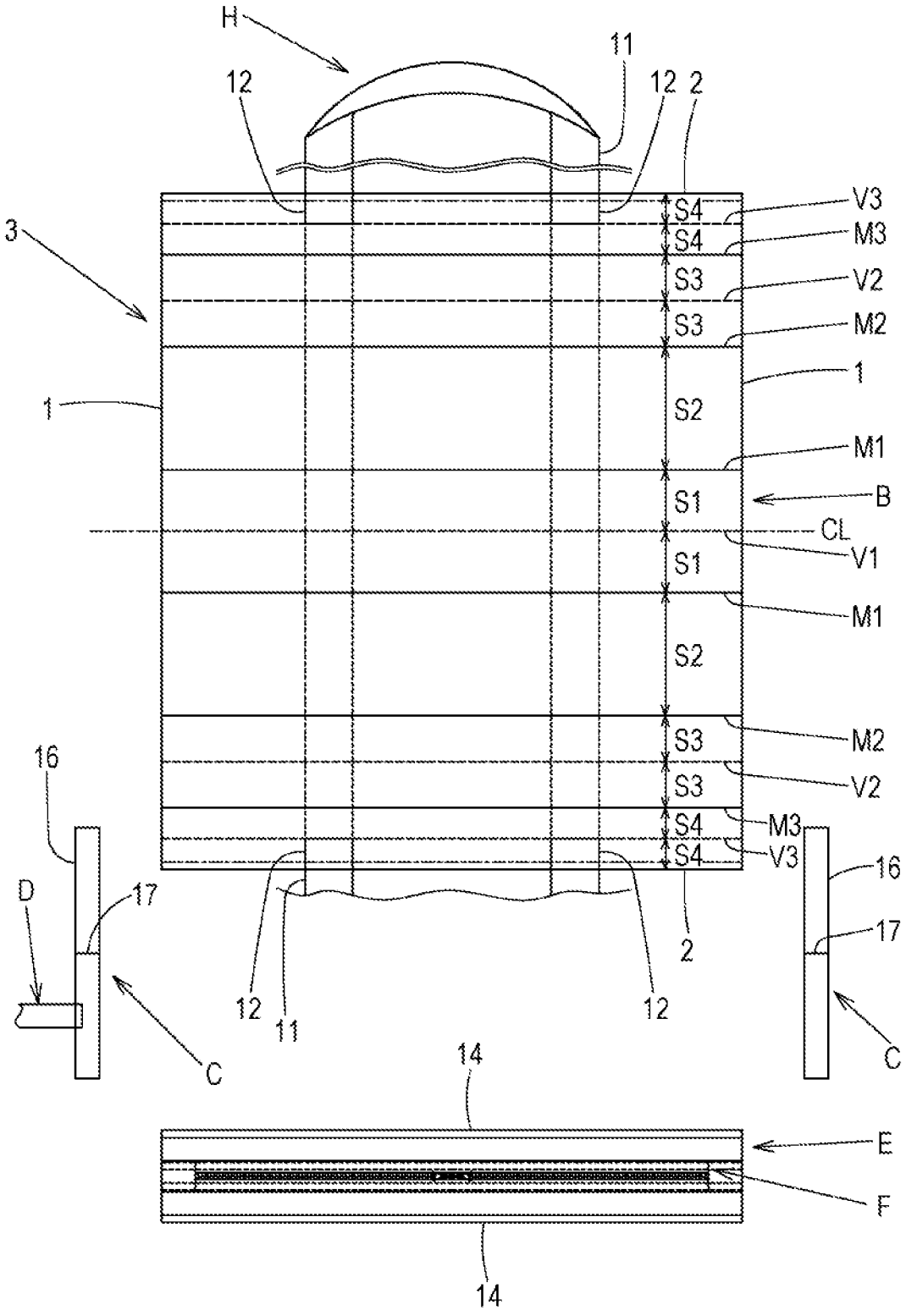
FIG. 2 shows individual parts of the bag of the example in a disassembled state.

In FIGS. 1 and 2, A is a foldable bag; B is a storage main body that is foldable into a rectangular flat shape by forming a plurality of inner pleats; C is a bundle end part sewn to a folded side end portion 4 of the storage main body B to seal side ends of the plurality of inner pleats formed in the folded storage main body B in a stacked state; D is a retaining band for folding and binding the storage main body B in the longitudinal direction; E is a storage entrance part for insertion and removal of an article to be stored into and from the storage main body B; and H is a handle attached outside the storage entrance part E of the folded storage main body B.

As shown in FIG. 2, the storage main body B is formed of a single rectangular sheet material 3 defined by long sides 1 and short sides 2.

Although a polyester fabric is used as the material for the sheet material 3 in this example, any flexible sheet material having the required strength and bendability can be used, including fabrics formed of synthetic and natural fibers such as nylon and cotton and laminated materials obtained by coating such fabrics with synthetic resins.

Figure 4:
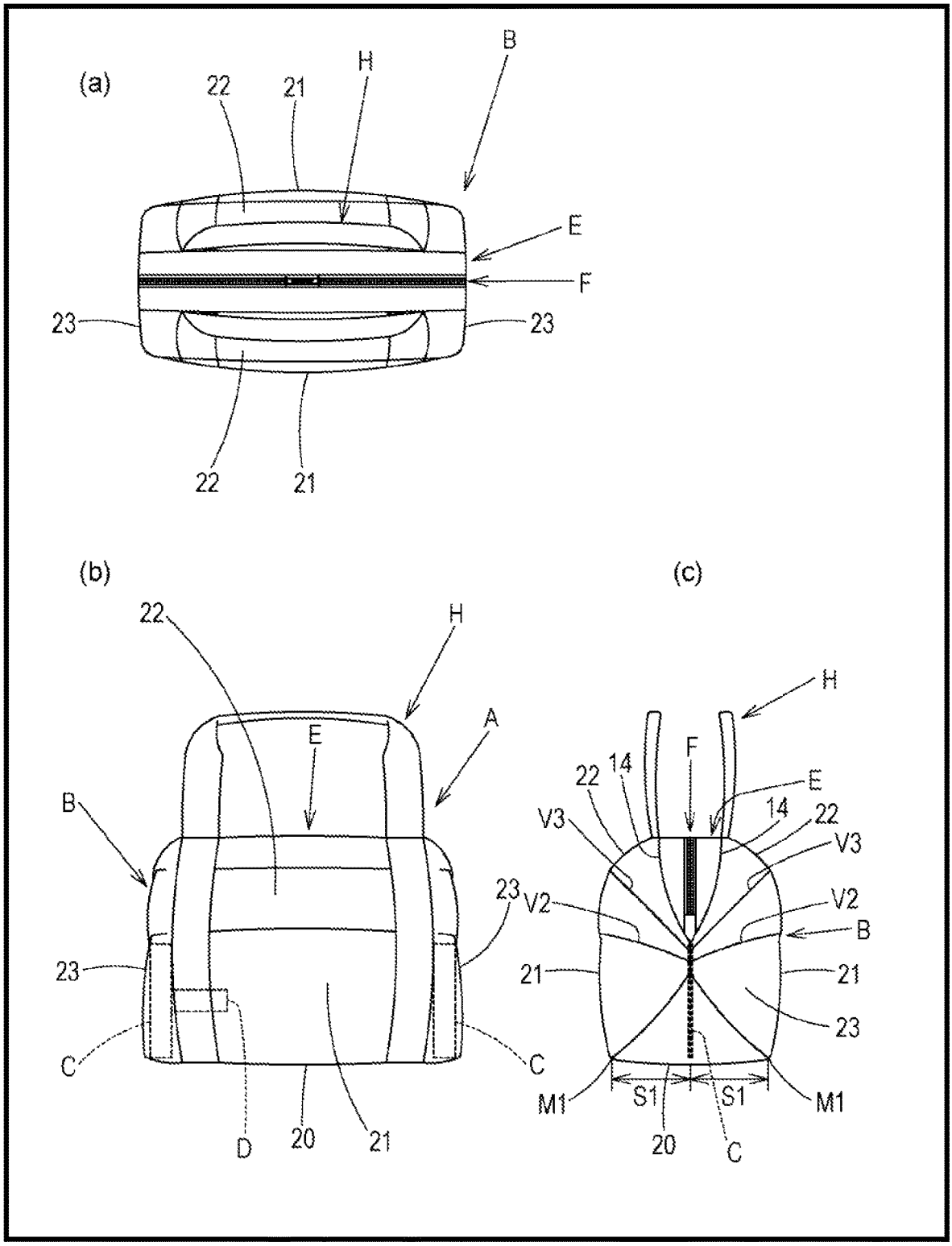
FIG. 4 shows the bag of the example in a usable state, where (a) is a top view, (b) is a front view, and (c) is a side view.

To form pleats with line symmetry on both sides of a centerline CL that is a perpendicular bisector of the long sides 1, the sheet material 3 has a first valley fold line V1 formed along the centerline CL; a pair of first mountain fold lines M1 formed at a spacing S1 that is half the width of a bottom gusset 20 (see FIG. 4(*c*)) from the first valley fold line V1 toward both short sides 2; a pair of second mountain fold lines M2 formed at a spacing S2 that is twice or more the spacing S1 from the first mountain fold lines M1 toward the short sides 2; a pair of second valley fold lines V2 formed at a spacing S3 narrower than the spacing S1 from the second mountain fold lines M2 toward the short sides 2; a pair of third mountain fold lines M3 formed at the spacing S3 from the second valley fold lines V2 toward the short sides 2; and a pair of third valley fold lines V3 formed at a spacing S4 narrower than the spacing S3 from the third mountain fold lines M3 toward the short sides 2. The width from the third valley fold lines V3 to the short sides 2 is set to the spacing S4.

Although the valley fold lines and the mountain fold lines in the sheet material 3 in this example are formed up to the third mountain fold lines M3 and the third valley fold lines V3, a plurality of sets of valley fold lines and mountain fold lines may be formed at a spacing that becomes gradually narrower than the spacing S3 from the third mountain fold lines M3 toward the short sides 2.

Figure 3:
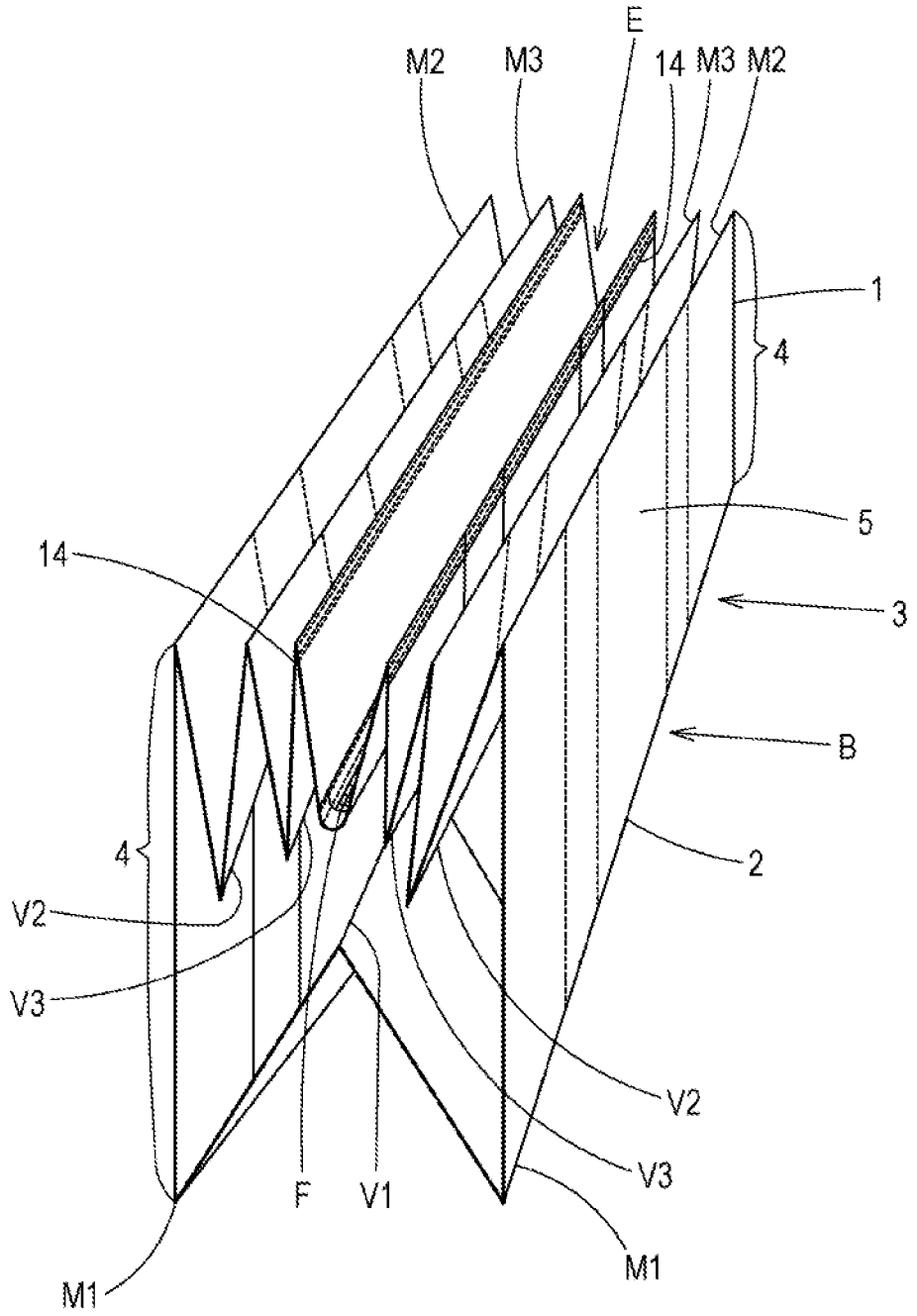
FIG. 3 is a schematic view illustrating a storage main body and a storage entrance part forming the bag of the example in a folded state.

As shown in FIG. 3, when the sheet material 3 of the storage main body B is folded along the valley fold lines V1 to V3 and the mountain fold lines M1 to M3, as shown in FIG. 1(*b*), folding surfaces 5 are formed on the front and rear sides of the vertical cross-section of the folded storage main body B. The folding surfaces 5 have the first mountain fold lines M1 on one end side in the longitudinal direction and the second mountain fold lines M2 on the other end side in the longitudinal direction, and the spacing between the one end side and the other end side is S2.

Furthermore, the storage main body B has an inner bottom pleat 6 formed at a width equal to the spacing S1 corresponding to the bottom gusset 20 from the one end side (first mountain fold lines M1) inwardly toward the other end side of the front and rear folding surfaces 5 in the longitudinal direction by the first valley fold line V1; first inner top pleats 7 formed at a width equal to the spacing S3 narrower than the spacing S1 from the other end side (second mountain fold lines M2) inwardly toward the one end side of the front and rear folding surfaces 5 in the longitudinal direction by the second valley fold lines V2; and second inner top pleats 8 formed at a width equal to the spacing S4 narrower than the spacing S3 by the third valley fold lines V3. The first and second inner top pleats 7 and 8 are formed in order inwardly toward the opposing side.

Although the inner top pleats in the storage main body B in this example are formed up to the second inner top pleats 8, a plurality of sets of inner top pleats may be formed from the other end side inwardly toward the one end side of the front and rear folding surfaces 5 in the longitudinal direction such that the pleats have a width that becomes gradually narrower inwardly toward the opposing side.

As shown in FIG. 2, the handles H are formed of tape-shaped materials 11 such that the entire handles H are U-shaped, and mounting end portions 12 of the handles H are sewn over the spacing S4 from the short sides 2 of the sheet material 3 forming the storage main body B.

Although the handles H in this example are formed of the tape-shaped materials 11 such that the entire handles H are U-shaped, the handles H are not limited to this shape; rather, handles of various shapes, such as shoulder straps, can be selected as needed.

As shown in FIG. 2, the storage entrance part E is formed in a rectangular shape using the same material as the sheet material 3 forming the storage main body B. As shown in FIG. 1(*b*), a pair of mounting edge portions 14 defining the long sides are sewn along the short sides 2 of the sheet material 3 having the handles H sewn thereto in a stacked state.

Furthermore, the storage entrance part E is configured to be opened and closed by opening and closing a zipper F attached to the center thereof.

As shown in FIG. 2, the bundle end parts C are formed from a pair of tape-shaped materials 16 having an overall length set to more than twice the spacing S2, which is the width of the folding surfaces 5 of the sheet material 3. To seal the side ends of the plurality of inner pleats formed in the storage main body B in a stacked state, the tape-shaped materials 16 are folded back along fold lines 17 and are sewn so as to hold the folded side end portions 4 of the storage main body B.

Furthermore, one end of a ring-shaped rubber retaining band D for folding and binding the storage main body B shown in FIG. 1(*a*) in the longitudinal direction is sewn to one of the bundle end parts C so as to extend outward from near the center thereof.

Although the retaining band D used in this example is a ring-shaped rubber band, the retaining band D is not limited to this type; rather, a button may be attached to an end portion of a tape-shaped retaining band, and a receiving portion that cooperates with the button may be attached to the storage main body B.

As described above, the foldable bag A is fabricated in a folded state. Next, the appearance of the foldable bag A in a usable state will be described with reference to FIG. 4.

As shown in the side view of FIG. 4(*c*), the foldable bag A expanded into a usable state is composed of a bottom gusset (bottom surface) 20 having a width of twice the spacing S1, front and rear body portions 21 (from the first mountain fold lines M1 to the second valley fold lines V2) rising substantially perpendicularly from the front and rear (first mountain fold lines M1) of the bottom gusset 20, top gussets (top surface) 22 (from the second valley fold lines V2 to the mounting edge portions 14 of the storage entrance part E) that extend from the body portions 21 to the storage entrance part E on the upper side thereof and that are round in side view, and side gussets 23 extending from both sides of the bottom gusset 20, the body portions 21, and the top gussets 22.

Next, the manner of use and the operation and effect of this example will be described with reference to the drawings.

As shown in FIG. 2, after the mounting end portions 12 of the handles H are sewn to the short sides 2 of the sheet material 3 forming the storage main body B of the foldable bag A of this example, the handles H are folded back along the short sides 2 of the sheet material 3, and the mounting edge portions 14 of the storage entrance part E are sewn along the short sides 2 of the sheet material 3 from over the handles H.

Subsequently, as shown in FIG. 3, after the storage main body B having the handles H and the storage entrance part E sewn thereto is folded along the valley fold lines V1 to V3 and the mountain fold lines M1 to M3, the bundle end parts C are sewn to the side end portions 4. Furthermore, the retaining band D is sewn to one of the bundle end parts C. Thus, as shown in FIG. 1(*a*), the foldable bag A is fabricated in a folded state.

Next, a procedure of expanding the folded foldable bag A into a usable state will be described with reference to FIG. 5.

First, the retaining band D is detached from the bound storage main body B. As shown in FIG. 5(*a*), the foldable bag A is extended in the lateral direction, with the storage entrance part E facing downward.

Subsequently, the zipper F of the storage entrance part E is fully opened. As shown in FIG. 5(*b*), the handles H are withdrawn from inside the storage main body B, and the entire foldable bag A is turned inside out in the directions of the arrows.

Figure 5:
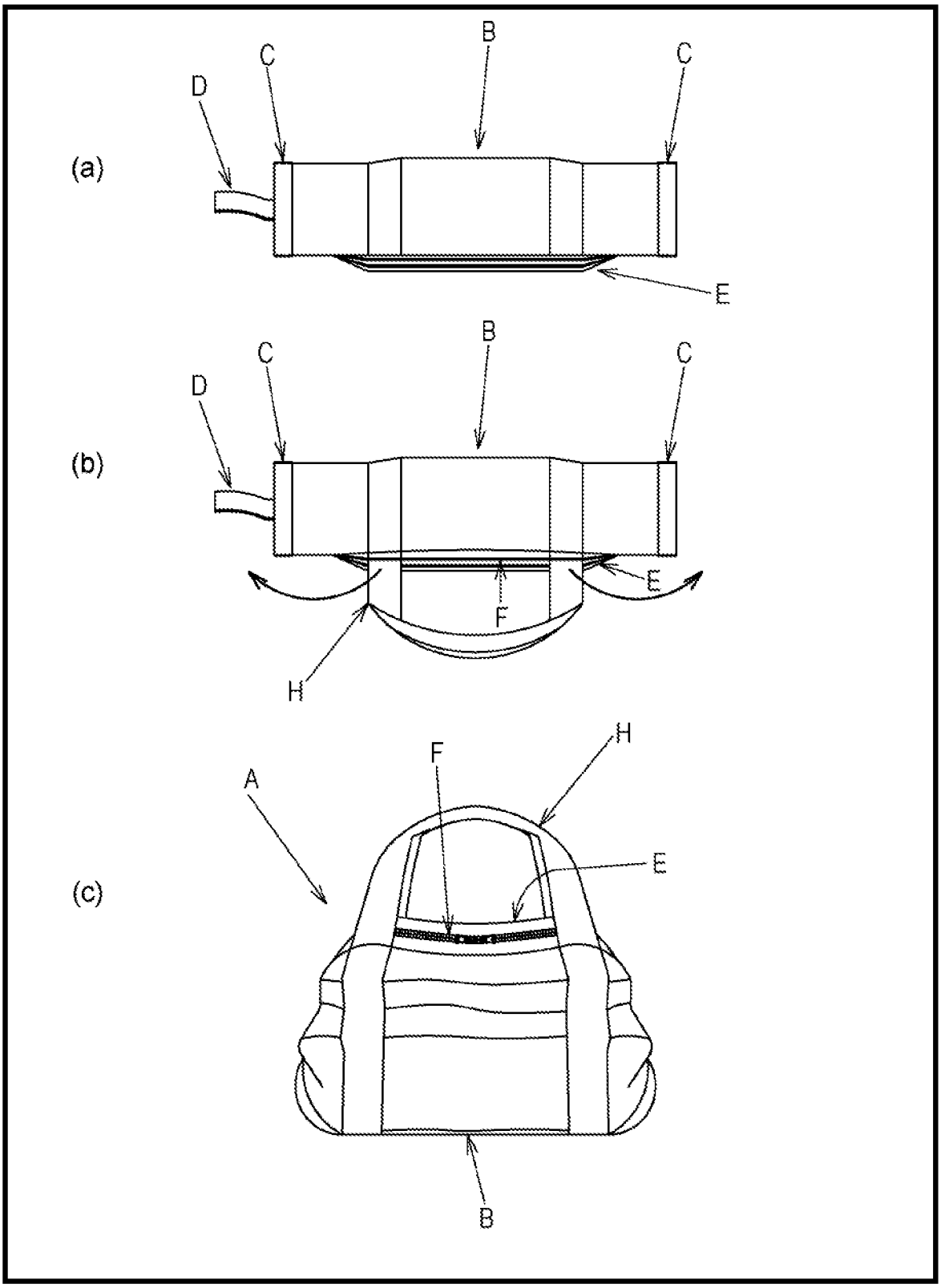
FIG. 5 illustrates a procedure of expanding the bag of the example, where (a) shows a state in which a retaining band is detached, and the bag is extended in the longitudinal direction; (b) shows a state in which the entire bag is turned inside out; and (c) shows a state in which the entire bag is expanded.

Thus, as shown in FIG. 5(*c*), the foldable bag A is in a usable state. After an article to be stored is inserted through the storage entrance part E, the zipper F is closed, and the handles H can be gripped by hand and used.

As described above, as shown in FIG. 4(*c*), the foldable bag A expanded into a usable state includes, as its appearance, the flat bottom gusset 20, the front and rear body portions 21 rising substantially perpendicularly from the front and rear of the bottom gusset 20, and the top gussets 22 that are round from the body portions 21 toward the storage entrance part E on the upper side thereof. Thus, an excellent design that is distinct in appearance from conventional foldable bags can be achieved.

Next, a procedure of folding the foldable bag A into a compact form after use will be described with reference to FIG. 6.

First, the zipper F of the foldable bag A is fully opened, and the article stored therein is removed therefrom. Subsequently, as shown in FIG. 6(*a*), both hands are inserted through the storage entrance part E into the storage main body B, and the bundle end parts C on the inside thereof are gripped and directed outward so as to turn the foldable bag A inside out.

Figure 6:
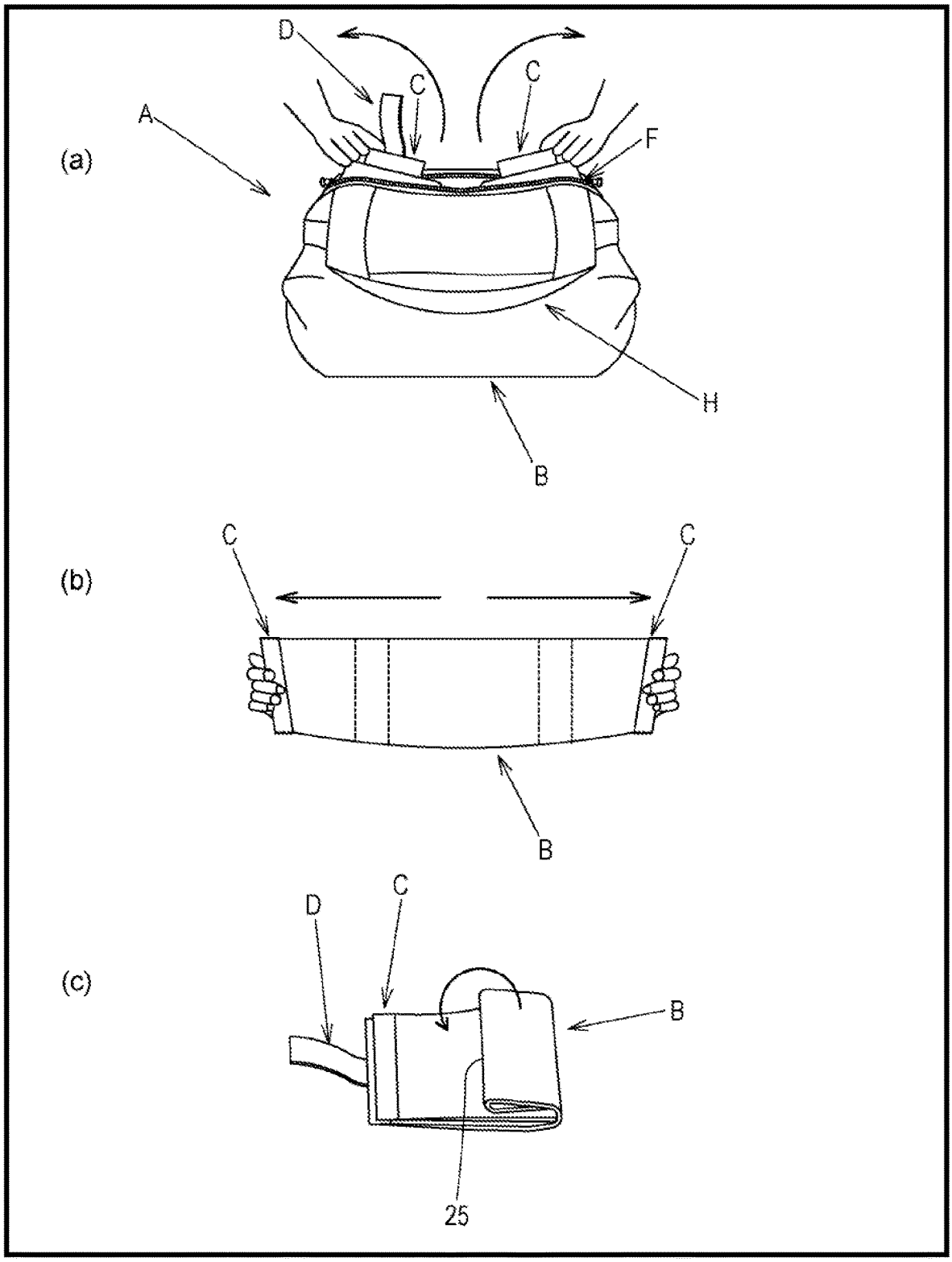
FIG. 6 illustrates a procedure of folding the bag of the example, where (a) shows a state in which bundle end parts on the inside thereof are gripped to turn the bag inside out; (b) shows a state in which both ends of the storage main body are tensioned in directions away from each other; and (c) shows a state in which the storage main body folded in half is rolled up in the longitudinal direction.

Subsequently, as shown in FIG. 6(*b*), the bundle end parts C are pulled in directions away from each other by both hands. If the foldable bag A cannot be successfully folded with a single action, the storage main body B can be folded into a rectangular flat shape by pulling the bundle end parts C again in the lateral direction.

Subsequently, after the handles H are inserted into the storage main body B, the zipper F is closed. Thus, the foldable bag A can be returned to the state in FIG. 5(*a*) described above.

Subsequently, after the storage main body B is folded in half, as shown in FIG. 6(*c*), the storage main body B is folded into a compact form from the fold line 25 side and is finally bound with the rubber retaining band D. Thus, folding is completed.

Although the storage entrance part E of the foldable bag A in this example is configured to be opened and closed with the zipper F, the storage entrance part E is not limited thereto; for example, the storage entrance part E may be configured to be opened and closed with Magic Tape (registered trademark).

INDUSTRIAL APPLICABILITY

The foldable bag of the present invention can be shaped as its appearance in use such that the bottom surface is flat, the front and rear body portions stand upright, and the top surface is round, and the storage main body can be folded into a rectangular flat shape after use simply by turning the foldable bag inside out and tensioning the bundle end parts in directions away from each other. Thus, the foldable bag can be easily folded for carrying and is particularly suitable as a spare travelling bag for storing additional goods during travelling.

REFERENCE SIGNS LIST

A foldable bag
B storage main body
C bundle end part
D retaining band
E storage entrance part
F zipper
H handle
M1, M2, M3 mountain fold line
V1, V2, V3 valley fold line
S1, S2, S3, S4 spacing
1 long side
2 short side
3 sheet material
4 side end portion
5 folding surface
6 inner bottom pleat
7 first inner top pleat
8 second inner top pleat
11, 16 tape-shaped material
12 mounting end portion
14 mounting edge portion
17, 25 fold line
20 bottom gusset (bottom surface)
21 body portion
22 top gusset (top surface)
23 side gusset

The invention claimed is:

1. A foldable bag that is foldable into a rectangular flat shape, comprising:

a storage main body having a set of folding surfaces located on front and rear sides when the foldable bag is folded into the rectangular flat shape, an inner bottom pleat formed from one end side inwardly toward another end side of both front and rear folding surfaces in a longitudinal direction and having a width corresponding to a bottom gusset, and a plurality of sets of inner top pleats formed from the other end side inwardly toward the one end side of the front and rear folding surfaces in the longitudinal direction and having a width that becomes gradually narrower inwardly toward an opposing side;

a storage entrance part for insertion and removal of an article to be stored, the storage entrance part being formed on an innermost side of the plurality of sets of inner top pleats of the folded storage main body;

a set of bundle end parts sewn to folded side end portions of the storage main body to seal side ends of the inner bottom pleat and the plurality of sets of inner top pleats formed in the folded storage main body in a stacked state; and a handle attached outside the storage entrance part of the folded storage main body, wherein the storage main body is foldable by turning the foldable bag in a usable state inside out and tensioning the set of bundle end parts in directions away from each other.

2. The foldable bag according to claim 1, wherein the storage main body comprises a rectangular sheet material defined by long sides and short sides, and the sheet material is foldable along a first valley fold line formed on a perpendicular bisector of the long sides; a set of first mountain fold lines formed at a spacing S1 that is half a width of the bottom gusset from the first valley fold line toward the short sides and corresponding to the one end side of the front and rear folding surfaces in the longitudinal direction: a set of second mountain fold lines formed at a spacing S2 that is twice or more the spacing S1 from the first mountain fold lines toward the short sides and corresponding to the other end side of the front and rear folding surfaces in the longitudinal direction; a set of second valley fold lines formed at a spacing S3 narrower than the spacing S1 from the second mountain fold lines toward the short sides and corresponding to first inner top pleats; a set of third mountain fold lines formed at the spacing S3 from the second valley fold lines toward the short sides and corresponding to second inner top pleats; and a plurality of sets of valley fold lines and mountain fold lines formed at a spacing that becomes gradually narrower than the spacing S3 from the third mountain fold lines toward the short sides.

3. The foldable bag according to claim 1, wherein the storage main body includes a zipper for opening and closing the storage entrance part along the storage entrance part.

* * * * *